US006739297B2

(12) United States Patent
Palesch et al.

(10) Patent No.: US 6,739,297 B2
(45) Date of Patent: May 25, 2004

(54) ACTUATING DEVICE FOR SECURING A CAMSHAFT OF AN ENGINE OF A MOTOR VEHICLE IN A START POSITION

(75) Inventors: Edwin Palesch, Lenningen (DE); Alfred Trzmiel, Grafenberg (DE)

(73) Assignee: Hydraulik-Ring GmbH, Limbach-Oberfrohna (DE)

( * ) Notice: Subject to any disclaimer, the term of this patent is extended or adjusted under 35 U.S.C. 154(b) by 0 days.

(21) Appl. No.: 09/975,301

(22) Filed: Oct. 11, 2001

(65) Prior Publication Data

US 2002/0088417 A1 Jul. 11, 2002

(30) Foreign Application Priority Data

Oct. 11, 2000 (DE) ..... 100 50 225

(51) Int. Cl.[7] ..... F01L 1/34

(52) U.S. Cl. ..... 123/90.17; 251/129.1; 91/365

(58) Field of Search ..... 123/90.15, 90.16, 123/90.17, 90.18; 251/129.09, 129.01, 129.1; 91/469, 52, 378, 374, 365

(56) References Cited

U.S. PATENT DOCUMENTS 5,144,921 A * 9/1992 Clos et al. ..... 123/90.17
5,291,860 A * 3/1994 Quinn, Jr. ..... 123/90.17
5,355,849 A * 10/1994 Schiattino ..... 123/90.17
5,367,992 A * 11/1994 Butterfield et al. ..... 123/90.17
5,562,071 A * 10/1996 Urushihata et al. ..... 123/90.15
5,628,286 A * 5/1997 Kato et al. ..... 123/90.15
5,738,056 A 4/1998 Mikame et al. ..... 123/90
5,797,361 A 8/1998 Mikame et al. ..... 123/90
5,823,152 A * 10/1998 Ushida ..... 123/90.17
5,924,395 A 7/1999 Moriya et al. ..... 123/90
5,927,239 A * 7/1999 Kohrs et al. ..... 123/90.17
5,979,380 A 11/1999 Nakadouzono et al. ..... 123/90
6,007,708 A 12/1999 Ken et al. ..... 123/90
6,024,061 A 2/2000 Adachi et al. ..... 123/90
6,035,819 A 3/2000 Nakayoshi et al. ..... 123/90
6,053,139 A 4/2000 Eguchi et al. ..... 123/90
6,058,897 A 5/2000 Nakayoshi ..... 123/90
6,302,072 B1 10/2001 Sekiya et al. ..... 123/90
6,308,669 B1 * 10/2001 Lancefield et al. ..... 123/90.15
6,332,439 B2 12/2001 Sekiya et al. ..... 123/90
2001/0039932 A1 11/2001 Sekiya et al. ..... 123/90

* cited by examiner

*Primary Examiner*—Thomas Denion
*Assistant Examiner*—Jaime Corrigan
(74) *Attorney, Agent, or Firm*—Gudrun E. Huckett

(57) ABSTRACT

An actuating device for hydraulically securing a camshaft of an engine of a motor vehicle in a start position has a solenoid valve controlling the flow of a pressure medium to a camshaft adjuster with a rotary slide valve that is fixedly connected to the camshaft and moves the camshaft into the required start position according to the pressure medium supplied to it by the solenoid valve.

11 Claims, 7 Drawing Sheets

ACTUATING DEVICE FOR SECURING A CAMSHAFT OF AN ENGINE OF A MOTOR VEHICLE IN A START POSITION

BACKGROUND OF THE INVENTION

1. Field of the Invention

The invention relates to an actuating device for securing the camshaft of a engine of a vehicle, preferably a motor vehicle, in a start position.

2. Description of the Related Art

In order to be able to start the engine of a vehicle, the camshaft must be in a predetermined start position. It may happen that the motor is abruptly shut down while the camshaft is in a displaced camshaft position, for example, upon accidental release of the clutch at increased rpm (revolutions per minute) when driving away from a stop at a traffic light. Since the camshaft adjustment is occurring at increased rpm, the camshaft adjuster does not have sufficient time to reach the start position corresponding to the low rpm. The engine is thus turned off with the camshaft being in the displaced position. This has the result that the engine cannot be started or can be started only with difficulty.

SUMMARY OF THE INVENTION

It is an object of the present invention to configure the actuating device of the aforementioned kind such that the camshaft, after turning off the engine, reliably reaches its start position.

In accordance with the present invention, this is achieved in that the camshaft is moved into its start position by a positive control.

In the actuating device according to the invention, the camshaft is moved by a positive control into its start position and is secured therein. This ensures that the camshaft, when turning off the engine, reliably reaches its start position. The engine can thus be started again without problems. By means of the positive control it is also achieved that the camshaft reaches the start position required for starting the engine even when it is in a different position as a result of, for example, the engine having been killed accidentally at increased rpm. When the starter in this case is actuated, the positive control achieves that the camshaft will reach the start position already after a short period of time.

DESCRIPTION OF THE PREFERRED EMBODIMENTS

Figure 1:
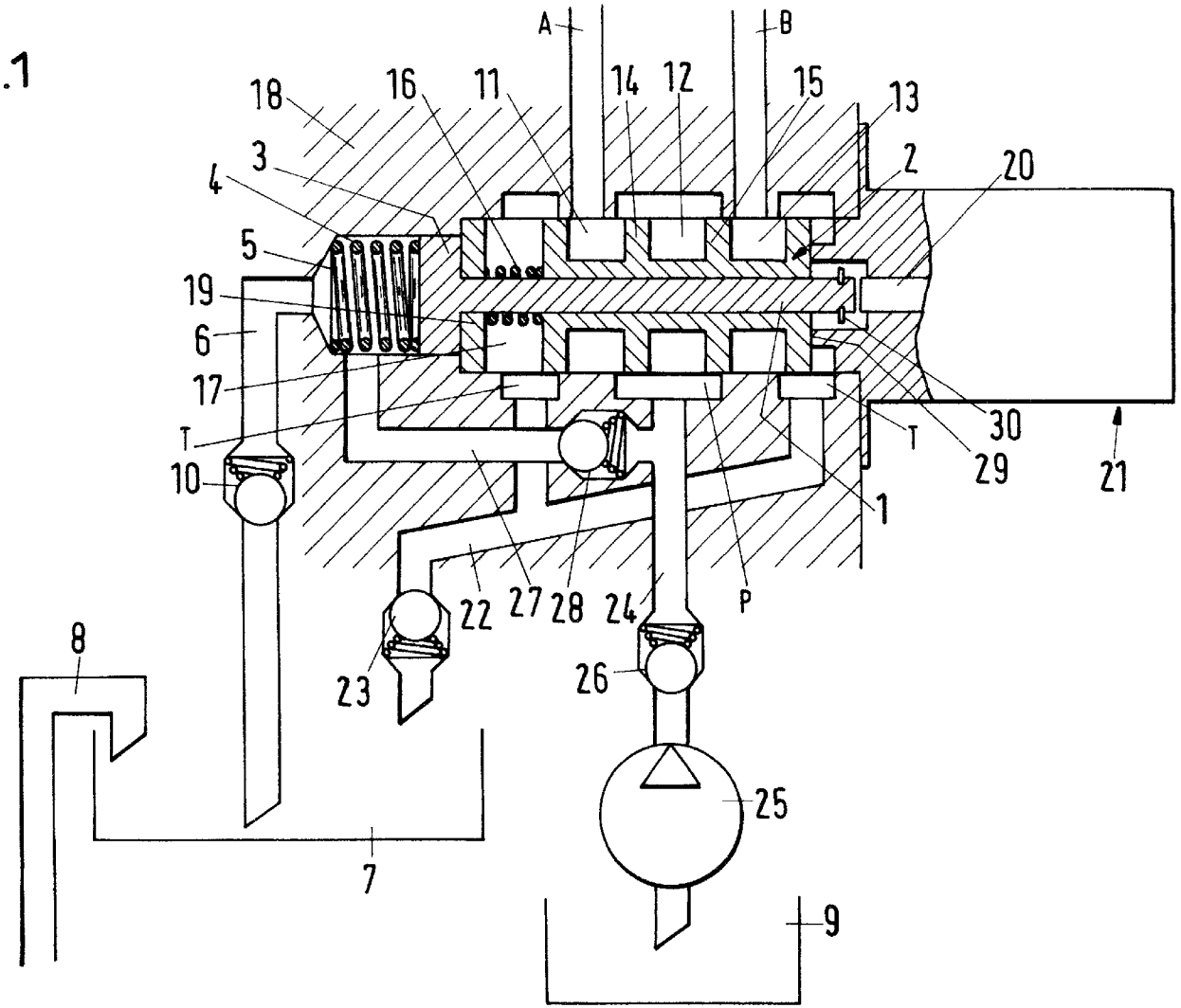
FIG. 1 shows an actuating device according to the invention.

The actuating device according to FIG. 1 has a piston rod 1 on which a slide 2 is seated. The piston rod 1 is provided at its one end, shown to the left in FIG. 1, with a piston 3 on which one end of a pressure spring 4 is supported. The pressure spring 4 is positioned in a pressure chamber 5 into which a hydraulic line 6 opens. It connects the pressure chamber 5 with an intermediate storage 7 which is connected by an overflow line 8 with the pressure medium tank 9 containing a pressure medium, preferably a hydraulic medium. In the hydraulic line 6 a check valve 10 is positioned which opens in the direction toward the pressure chamber 5.

The slide 2 is provided at its periphery with three annular grooves 11 to 13, which are separated from one another by annular stays 14, 15. The slide 2 is subjected to the force of at least one pressure spring 16 which is arranged in a pressure chamber 17 of a valve housing 18. The pressure chamber 17 is separated by a housing wall 19 from the pressure chamber 5.

The piston rod 1 is moved by a plunger 20 against the force of the pressure spring 4. The plunger 20 is part of a solenoid valve 21 which, in addition to the piston rod 1, also comprises the slide 2. The plunger 20 is moved, as is known in the art, by an armature (not illustrated) when the solenoid valve 21 is supplied with current.

The solenoid valve 21 has two tank connectors T which are connected to a common tank line 22 which opens into the intermediate storage 7. In the tank line 22 a check valve 23 is provided which opens in the direction toward the intermediate storage 7.

The pressure connector P is located between the two tank connectors T and has a pressure line 24 connected thereto. The hydraulic medium is conveyed by a pump 25 from the tank 9 into the pressure line 24, and the pressure line 24 has a check valve 26 arranged therein and closing in the direction toward the tank 9.

A branch line 27 branches off the pressure line 24 in an area upstream of the pressure connector P. It connects the pressure chamber 5 with the pressure line 24. In the branch line 27 a check valve 28 is provided which opens in the direction toward the pressure line 24.

The solenoid valve 21 is also provided with two work connectors A, B. The work connector A is provided in order to move the crankshaft of an internal combustion engine into a start position for starting the engine. The work connector B is provided for adjusting the camshaft when the internal combustion engine is running.

Figure 10:
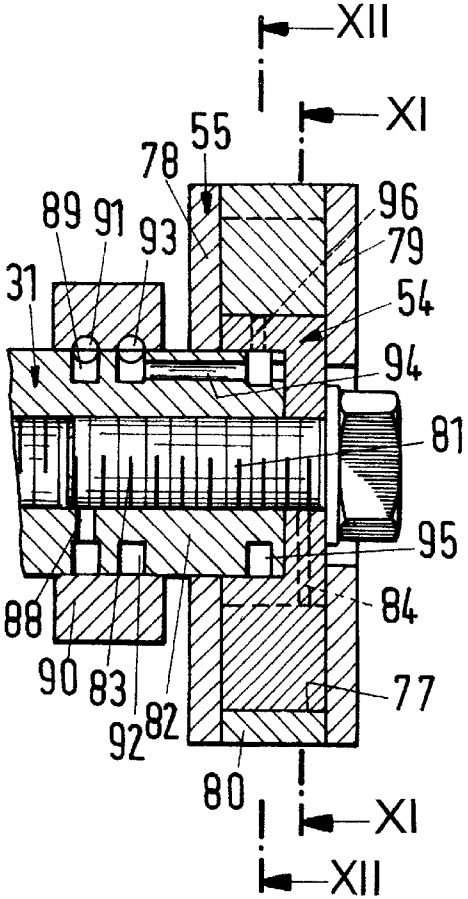
FIG. 10 is an axial section of a camshaft adjuster which is actuated by the actuating device according to the invention.
Figure 11:
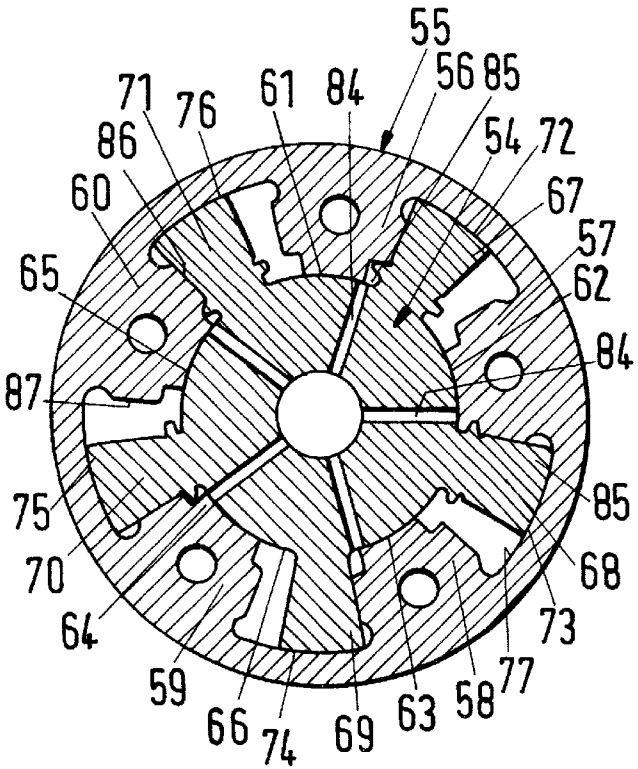
FIG. 11 is a section along the line XI—XI of FIG. 10.
Figure 12:
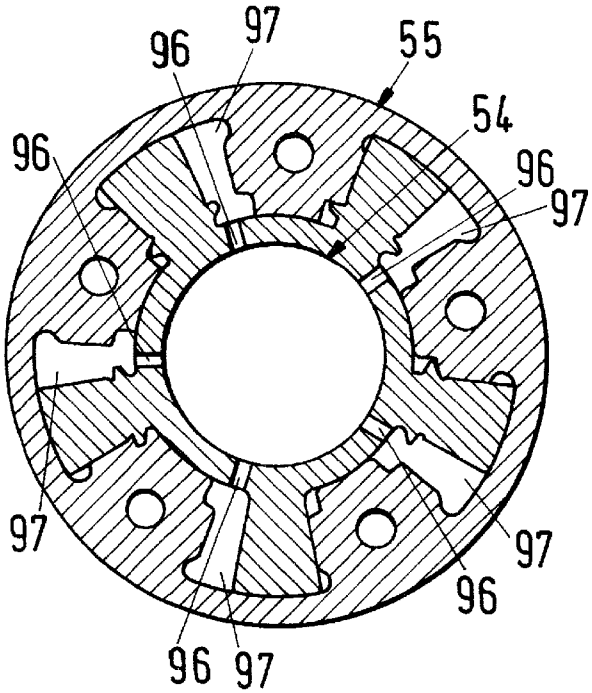
FIG. 12 is a section along the line XII—XII of FIG. 10.

In the initial position, in which the solenoid valve 21 is not actuated, the piston 3 of the piston rod 1 rests under the force of the pressure spring 4 and under the force of the hydraulic medium present within the pressure chamber 5 against the housing wall 19. The slide 2 rests under the force of the pressure spring 16 on a stop 29 provided at the housing 18. In this position, the central annular groove 12 of the slide 2 is connected by the pressure connector P to the annular groove 11 and thus with the work connector A. The work connector B is separated by the annular stay 15 from the pressure connector P and is connected with the tank connector T. Should the camshaft not be in the start position because the engine was accidentally shut off, upon actuation of the starter of the vehicle the slide 2 is moved in an oscillating fashion so that additional hydraulic medium reaches the camshaft adjuster 32 (FIG. 10 to FIG. 12). The additional hydraulic medium ensures that the camshaft is rotated into the start position. As soon as the starter is turned off again, additional hydraulic medium is no longer conveyed. The hydraulic medium can flow from the tank 9 under pressure via the pressure line 24, the pressure connector P, and the annular groove 11 to the work connector A so that the crankshaft and thus the camshaft are hydraulically moved into and secured in the start position. This will be explained in detail in connection with FIGS. 10 through 12. The intermediate or auxiliary storage 7 provides an auxiliary hydraulic medium volume so that the piston 3 can be adjusted very quickly into the initial position according to FIG. 1. The intermediate storage 7 is open to the atmosphere. By means of the auxiliary hydraulic medium volume, so much hydraulic medium is applied to the camshaft adjuster 32 during the starting operation that the camshaft is moved into the start position with the first rotations and is optionally locked in this position.

As soon as the vehicle has been started and the crankshaft and the camshaft are thus rotating, the solenoid valve 21 is actuated for the adjustment of the camshaft during travel. Accordingly, the plunger 20 moves first the piston rod 1 and accordingly the piston 3 against the force of the pressure spring 5. The hydraulic medium within the hydraulic chamber 5 is displaced via the branch line 27 into the pressure line 24. A stop 30 is seated on the piston rod 1; the stop 30 in the shown embodiment is a spring ring inserted into an annular groove of the piston rod 1. As soon as the stop 30 comes to rest against the slide 2, the slide 2 is entrained against the force of the pressure spring 16. The slide 2 is moved so far that the work connector A is separated by the annular stay 14 from the pressure connector P and that the work connector B is connected with the pressure connector P. The hydraulic medium present within the pressure chamber 17 is thus displaced via the tank connector T and the tank line 22 back to the intermediate storage 7. By means of the solenoid valve 21, the camshaft can be adjusted in the desired way by means of the camshaft adjuster 32 (FIG. 10 through FIG. 12) during travel of the vehicle.

When the internal combustion engine is turned off, the solenoid valve 21 is switched, i.e., no longer supplied with current. The pressure springs 4 and 16 accordingly move the piston 3 and the slide 2 into the initial position illustrated in FIG. 1. The hydraulic medium supplied via the hydraulic line 6 assists the return movement of the piston 3 until it rests again against the housing wall 19 functioning as a stop. When returning the slide 2, the connection between the pressure connector P and the work connector B is separated and the connection between the pressure connector P and the work connector A is opened. The pressurized hydraulic medium flowing via the work connector A ensures that the camshaft is secured in the start position.

Figures 2, 3, 4, 5, 6, 7, 8, 9:
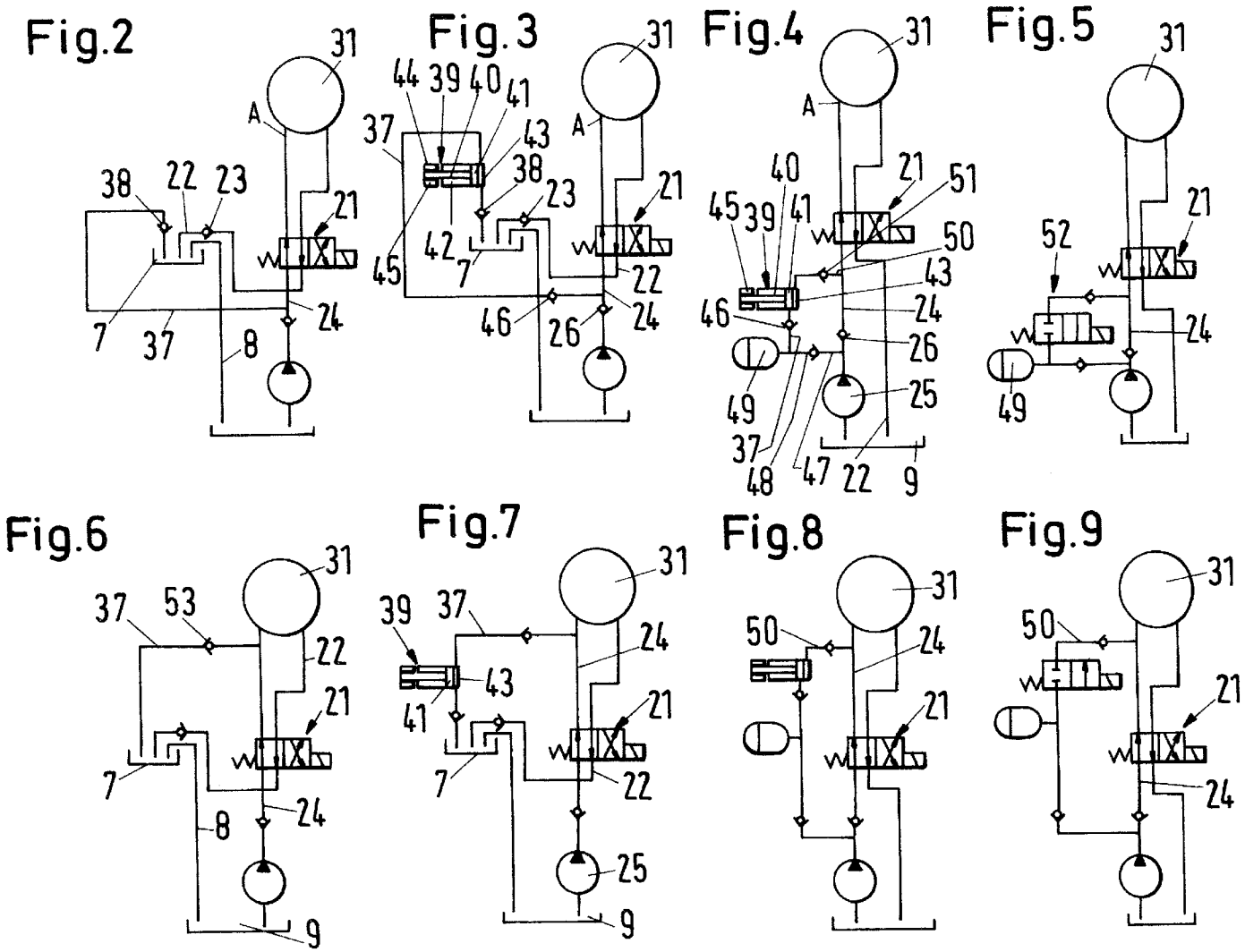
FIG. 2 is a hydraulic circuit diagram of a first embodiment of the actuating device according to the invention.
FIG. 3 is a hydraulic circuit diagram of a second embodiment of the actuating device according to the invention.
FIG. 4 is a hydraulic circuit diagram of a third embodiment of the actuating device according to the invention.
FIG. 5 is a hydraulic circuit diagram of a fourth embodiment of the actuating device according to the invention.
FIG. 6 is a hydraulic circuit diagram of a fifth embodiment of the actuating device according to the invention.
FIG. 7 is a hydraulic circuit diagram of a sixth embodiment of the actuating device according to the invention.
FIG. 8 is a hydraulic circuit diagram of a seventh embodiment of the actuating device according to the invention.
FIG. 9 is a hydraulic circuit diagram of an eighth embodiment of the actuating device according to the invention.

FIG. 2 shows an actuating device with which the camshaft 31 is hydraulically moved into a start position. The camshaft is only schematically illustrated in FIGS. 2 to 9.

The solenoid valve 21 in the position according to FIG. 2 is not supplied with current so that the pressurized hydraulic medium flows via the pressure line 24 to the work connector A of a camshaft adjuster 32 (FIGS. 10 through 12). It has pressure chambers 97 (FIG. 12) into which the hydraulic medium can flow to move the camshaft 31 into the start position in a way to be described later. The hydraulic medium which is present in the unloaded pressure chambers 85 is displaced via the tank line 22 and the check valve 23 into the intermediate storage 7.

Since the camshaft is moved into a defined start position in the way described, the internal combustion engine of the motor vehicle can be started perfectly. An intermediate line 37 acting as a supply line for the auxiliary volume branches off the pressure line 24 and opens into the intermediate storage 7. It closes in the direction of the intermediate storage 7 by a check valve 38.

As soon as the internal combustion engine has started, the solenoid valve 21 is switched. Accordingly, the pressurized hydraulic medium reaches the pressure chambers 85 (FIG. 11, FIG. 12) and rotates the camshaft 31 in the opposite direction. The hydraulic medium which is present in the pressure chambers 97 is displaced via the work connector A and the tank line 22 back to the intermediate storage 7. The solenoid valve 21 is a proportional solenoid valve so that the camshaft 31 can be rotated into greatly differing positions depending on the required adjustments.

In the embodiment according to FIG. 3, an electromagnetic pump 39 is arranged in the intermediate line 37. The pump 39 has an armature 40 which is formed as a piston rod and supports a piston 41 at its free end. The piston 40 separates two pressure chambers 42, 43 within a cylinder 44 from one another. The armature 40 is surrounded in the area external to the cylinder 44 by a coil 45. The intermediate line 37 extends via the pressure chamber 43 into the intermediate storage 7. A check valve 38 is positioned in the intermediate line 37 in the area between the electromagnetic pump 39 and the intermediate storage 7; this check valve 38 shuts off in the direction toward the intermediate storage 7. In other respects, the actuating device is of the same configuration as that of the embodiment of FIG. 2.

When the internal combustion engine of the motor vehicle is turned off, hydraulic pressure is present at the connector A so that the camshaft 31 is rotated according to the preceding embodiment so far that it reaches its start position (FIG. 12). The hydraulic medium present within the pressure chambers 85 (FIG. 11) is returned via the solenoid valve 21 and the tank line 22 to the intermediate storage 7. The coil 45 of the electromagnetic pump 39 is excited so that the armature 40 is moved to the right in FIG. 3. Accordingly, the pump 39 forces the hydraulic medium out of the intermediate storage 7 into the pressure line 24 via the intermediate line 37 and a check valve 46 arranged therein. By means of the intermediate storage 7, it is thus ensured in accordance with the preceding embodiments that the camshaft 31 is quickly rotated into the described start position by means of the auxiliary volume of the hydraulic medium that is additionally supplied to the pressure line 24.

The intermediate line 37 opens in accordance with the embodiment of FIG. 2 in the area between the check valve 26 and the solenoid 21 into the pressure line 24.

When the internal combustion engine is started, the solenoid valve 21 is switched. The hydraulic medium which is under pressure reaches now the pressure chambers 85 so that the camshaft 31 is rotated in the opposite direction. The hydraulic medium present within the pressure chambers 97 is then displaced via the tank line 22 and the check valve 23 seated therein into the intermediate storage 7. Moreover, the coil 45 is switched off so that the armature 40 is moved to the left of FIG. 3 by the spring force. In this connection, the hydraulic medium is sucked in from the intermediate storage 7 into the pressure chamber 43 so that it is immediately available as an auxiliary volume upon turning off the internal combustion engine and switching on the pump 39.

In the embodiment according to FIG. 4, a branch line 47 branches off the pressure line 24 in the area between the pump 25 and the check valve 26; a check valve 48 is seated in the branch line 47 and shuts off flow in the direction toward the pressure line 24. The branch line 47 is connected to an auxiliary storage (pressure storage) 49 in which hydraulic medium is stored under pressure. In the area between the check valve 48 and the pressure storage 49 an intermediate line 37 branches off the branch line 47. A check valve 46 which closes in the direction of the branch line 47 is positioned in the intermediate line 37. The line 37 is connected to the electromagnetic pump 39. When the coil 45 of the pump 39 is not excited, the armature 40 is in the position illustrated in FIG. 4 in which the piston 41 of the armature 40 blocks the intermediate line 37. An intermediate line 50 opens into the pressure chamber 43 of the pump 39; a check valve 51 is seated within the intermediate line 50 and closes in the direction of the pressure chamber 43. The line 50 opens into the pressure line 24 in the area between the check valve 26 and the solenoid valve 21.

When the internal combustion engine is switched off, the hydraulic medium is conveyed by the pump 25 from the tank 9 via the pressure line 24 and the solenoid valve 21 to the connector A of the camshaft adjuster 32 of the camshaft 31 (FIG. 4, FIG. 10). The camshaft 31 is rotated accordingly into the described stop position. The hydraulic medium present within the pressure chambers 85 of the camshaft adjuster 32 is displaced via the tank line 22 to the tank 9. In this way the camshaft 31 is rotated and secured quickly in its start position. In order to accelerate this adjustment, the coil 45 of the pump 39 is excited at the same time so that the armature 40 is pulled back and the piston 41 opens the intermediate line 37. The hydraulic medium present within the pressure storage 49 can thus flow under pressure via the check valve 46 into the pressure chamber 43 of the pump 39. From here, the hydraulic medium flows via the check valve 51 into the pressure line 24. With this auxiliary hydraulic volume the camshaft 31 is quickly rotated into its start position.

Corresponding to the preceding embodiments, it is ensured that the combustion engine can be started reliably because the camshaft is in its start position. Should the camshaft not be in the start position because the internal combustion engine has been turned off accidentally, the auxiliary hydraulic volume ensures, as in the preceding embodiments, that the camshaft upon actuation of the starter is quickly moved into its start position. As soon as the internal combustion engine runs, the solenoid valve 21 is switched so that the pressure chambers 85 of the camshaft adjuster 32 are connected to the pressure line 24 and the pressure chambers 97 of the camshaft adjuster 32 to the tank line 22. Moreover, the coil 45 of the pump 39 is switched off so that the armature 40 will be returned into the initial position illustrated in FIG. 4 in which the piston 41 blocks the intermediate line 37. Accordingly, the hydraulic medium present within the pressure storage 49 can no longer flow into the pressure line 24. Upon return of the armature 40, the hydraulic medium still present in the pressure chamber 43 is displaced via the intermediate line 50 into the pressure line 24.

In the embodiment according to FIG. 5, instead of the electromagnetic pump 39, a further solenoid valve 52 is provided with which the flow of the hydraulic medium from the pressure storage 49 into the pressure line 24 is controlled. When the camshaft is to be secured in the start position, the solenoid valve 21 is switched such that the pressure chambers 97 of the camshaft adjuster 32 are connected with the pressure line 24. Moreover, the solenoid valve 52 is switched from the position illustrated in FIG. 5 so that the intermediate line 37 is connected with the intermediate line 50. The pressurized hydraulic medium within the pressure storage 49 can now be conveyed additionally into the pressure line 24 so that the camshaft 31 can be rotated quickly into its stop position.

As soon as the internal combustion engine runs, the two solenoid valves 21 and 52 are again switched. The pressure chambers 85 of the camshaft adjuster 32 are connected by the pressure line 24 while the pressure chambers 97 are connected to the tank line 22. Accordingly, the hydraulic medium present within the pressure chambers 97, upon return movement of the camshaft 31, can be displaced into the tank 9. By switching the solenoid valve 52, the intermediate line 50 is separated from the intermediate line 37 and thus from the pressure storage 49 so that additional hydraulic medium can no longer reach the pressure line 24.

The actuating device according to FIG. 6 is of a similar configuration as the embodiment of FIG. 2. It has in addition to the tank 9 the intermediate storage 7 which is connected by the overflow line 8 to the tank 9. The intermediate storage 7 is connected by the intermediate line 37 with the pressure line 24. In contrast to the embodiment according to FIG. 2, the intermediate line 37 opens into the pressure line 24 in the area between the solenoid valve 21 and the camshaft 31.

When the camshaft is to be secured in the start position, the hydraulic medium is guided according to the preceding embodiments into the pressure chambers 97 of the camshaft adjuster 32 so that the camshaft 31 is rotated into its stop position. In the intermediate line 37 a check valve 53 is provided which opens in the direction of the camshaft adjuster 32. When the camshaft is rotated into the start position (FIG. 11 and FIG. 12), a vacuum is generated in the intermediate line 37 so that the hydraulic medium is sucked in from the intermediate storage 7 and is conveyed as an auxiliary volume into the pressure line 24. The camshaft 31 is thus quickly rotated into the start position. The hydraulic medium which is in the pressure chambers 85 of the camshaft adjuster 32 is guided via the tank line 22 back to the intermediate storage 7.

As soon as the internal combustion engine has been started, the solenoid valve 21 is switched so that the pressure chambers 85 of the camshaft adjuster 32 are connected to the pressure line 24 and the pressure chambers 97 are connected to the tank line 22. When rotating the camshaft 31 back, the check valve 53 is closed so that the hydraulic medium in the pressure chambers 97 is not displaced via the intermediate line 37 into the intermediate storage 7, but displaced only via the tank line 22.

The embodiment according to FIG. 7 corresponds substantially to the embodiment of FIG. 3. The intermediate line 37 opens in the area between the solenoid valve 21 and the camshaft 31 into the pressure line 24. In order to move the camshaft 31 into the start position, the hydraulic medium is conveyed by means of the pump 25 from the tank 9 via the pressure line 24 into the pressure chambers 97 of the camshaft adjuster 32 so that the camshaft 31 is rotated into the stop position. At the same time, the electromagnetic pump 39 is switched on so that the piston 41 is moved into the position of FIG. 7 and the hydraulic medium is conveyed from the pressure chamber 43 via the intermediate line 37 into the pressure line 24 as an auxiliary hydraulic volume. With this auxiliary volume, the rotation movement of the camshaft 31 into the start position is accelerated.

As soon as the internal combustion engine has been started, the solenoid valve 21 is switched from the position according to FIG. 7 so that the pressure chambers 97 of the camshaft adjuster 32 are connected with the tank line 22 and the pressure chambers 85 of the camshaft adjuster 32 with the pressure line 24. The hydraulic medium is then returned upon return movement of the camshaft 31 from the pressure chambers 97 via the tank line 22 into the intermediate storage 7.

The actuating device according to FIG. 8 corresponds substantially to the embodiment according to FIG. 4. The difference resides only in that the intermediate line 50 opens into the pressure line 24 in the area between the solenoid valve 21 and the camshaft 31.

The embodiment according to FIG. 9 differs from the embodiment according to FIG. 5 only in that the intermediate line 50 opens into the pressure line 24 in the area between the solenoid valve 21 and the camshaft 31.

In other respects, the embodiments of FIG. 8 and FIG. 9 function identically to the embodiments of FIG. 4 in FIG. 5.

FIGS. 10 through 12 show in detail the camshaft adjuster 32 with which the camshaft 31 can be rotated. On the camshaft 31 a rotary slide valve 54 is fixedly secured which is rotatable within a cylindrical housing 55 to a limited extent. The housing 55 has at its inner wall radially inwardly projecting stays 56 to 60 which are distributed uniformly about the inner periphery and have end faces 61 to 65 resting areally against the cylindrical outer mantle 66 of the rotary slide valve 54.

The rotary slide valve 54 has arms 67 to 71 projecting past the outer mantle 66 which engage between the stays 56 to 60 and with their curved end faces 72 to 76 rests areally against the cylindrical inner wall 77 of the housing 55. The width of the arms 67 to 71 measured in the circumferential direction is smaller than the spacing between neighboring stays 56 to 60.

The housing 55 has two parallel positioned annular lids 78, 79 (FIG. 10) between which the rotary slide valve 54 is positioned. The outer or peripheral edge of the two lids 78, 79 are connected to one another by a ring 80 which provides the cylindrical inner wall 77 of the housing 55. The two lids 78, 79 rest against the two lateral surfaces of the rotary slide valve 54.

The rotary slide valve 54 is seated on a threaded bolt 81 with which the rotary slide valve 54 is fastened to one end 82 of the camshaft 31. The camshaft end 82 projects through the housing lid 78 up to approximately half the axial length of the rotary slide valve 54. In the area of the camshaft end 82 the rotary slide valve 54 has a smaller wall thickness in comparison to the area external to the camshaft end 82 (FIG. 11 and FIG. 12). It is provided with a central axial bore 83 into which radially extending bores 84 (FIG. 11) open which penetrate the rotary slide valve 54. The bores 84 connect the central bore 83 with a pressure chamber 85, respectively, which is delimited by the stays 56 to 60 and the neighboring arms 67 to 71. FIG. 11 shows the rotary slide valve 54 in one stop position in which its arms 67 to 71 rests against the left sidewalls (as seen in FIG. 11) of the stays 56 to 60. The two sidewalls of the stays 56 to 60 are provided with projections 86 and 87 extending in the circumferential direction against which the arms 67 to 71 of the rotary slide 54 are resting. By means of these projections 86, 87 it is ensured that in the stop position illustrated in FIG. 11 the bores 84 are not completely closed by the stays 56 to 60.

The axial bore 83 of the distributor 82 is connected by a transverse bore 88 with an annular groove 89 which is provided in the outer mantle of the camshaft end 82 and is delimited by a ring 90 in the radially outward direction. A bore 91 opens into the annular groove 89; via the bore 91 the hydraulic medium is supplied from the tank 9 or the intermediate storage 7.

The camshaft end 82 is provided at its outer mantle surface with a further annular groove 92 (FIG. 10) which is closed off by a ring 90 radially outwardly and into which a bore 93 opens. An axial bore 94 is furthermore connected to the annular groove 92 which opens into an annular groove 95 in the camshaft end 82. Bores 96 which radially penetrate the rotary slide valve 54 open into the annular groove 95; these bores 96 are provided within the thinner wall area of the rotary slide valve 54 and open into the pressure chambers 97 which are provided between the stays 56 to 60 of the housing 55 and the arms 67 to 71 of the rotary slide valve 54. The pressure chambers 85 and 97 are separated from one another by arms 67 to 71 of the rotary slide valve 54.

In the positioned illustrated in FIGS. 10 through 12 the hydraulic medium is guided via the bores 96 under pressure into the pressure chambers 97 so that the arms 67 to 71 rests against the corresponding projections 86 of the stays 56 to 60. This position determines the start position of the camshaft 31.

By switching the solenoid valve 21 (not illustrated), the hydraulic medium is guided, in the way illustrated by the FIGS. 1 through 9, via the annular groove 89, the transverse bore 88, the axial bore 83, and the radial bore 84 into the pressure chambers 85. Accordingly, the rotary slide valve 54 is rotated in the illustration according to FIG. 11 and FIG. 12 in the clockwise direction relative to the housing 55 in the direction toward the oppositely positioned stays or projections 87. Since the rotary slide valve 54 is fixedly connected to the camshaft 31 so as to effect common rotation, the camshaft 31 is rotated by the corresponding amount. The hydraulic medium which is present in the pressure chambers 97 is displaced via the radial bores 96, the annular groove 95, the axial bore 94, the annular groove 92, and the bore 93 back to the tank 9 or to the intermediate storage 7.

Figure 13:
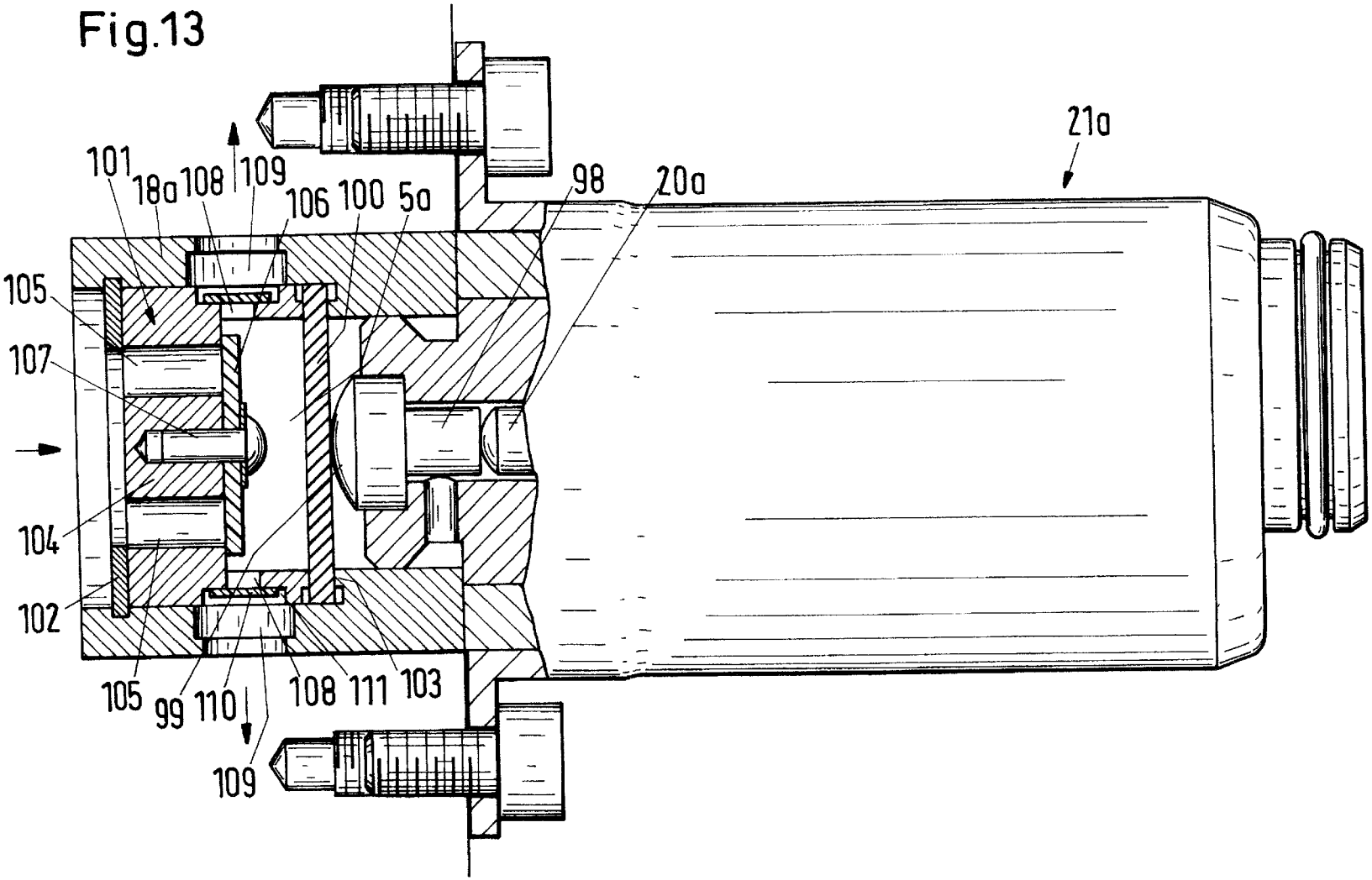
FIG. 13 shows a first embodiment of a solenoid valve of the actuating device according to the invention.

In the described embodiments, the valve part of the solenoid 21 acts as a pump with which the hydraulic medium is conveyed. FIG. 13 shows a solenoid valve 21*a* whose plunger 20*a* rests against a pressure piston 98. By means of a spherical head 99 the pressure piston 98 rests against a pressure element in the form of spring-elastic plate 100 which in this embodiment is comprised of a rubber-elastic material or of rubber. The plate 100 is clamped with its periphery in the housing 18*a*. For this purpose, a bushing 101 is inserted into the housing 18*a* which is secured by a securing ring 102 in the housing 18*a*. The plate 100 is clamped between the end of the bushing 101 facing away from the securing ring 102 and a radial shoulder surface 103 which projects from the inner wall of the housing 18*a*. The bushing 101 has a bottom 104 which is penetrated axially by at least one bore 105, in the illustrated embodiment by two bores 105. The bores 105 are closed off at the end facing away from the securing ring 102 by a valve element in the form of a valve disc 106 which is fastened by a screw 107 on the bottom 104 of the bushing 101. The valve disc 106 is configured to be elastically yielding at least in the edge area.

The bores 105 are connected to the hydraulic line 6 (FIG. 1) via which the hydraulic medium is supplied from the intermediate storage. The pressure chamber 5*a* is arranged between the plate 100 and the valve disc 106. The bushing 101 as well as the wall of the housing 18*a* is provided with transverse bores 108, 109 which are aligned with one another. The transverse bores 108 of the bushing 101 are closed by a ring 110 which can be elastically widened and which is arranged in an annular groove 111 in the outer wall of the bushing 101.

The solenoid valve 21*a* operates basically in the same way as has been described in connection with the embodiment of FIG. 1. When the plunger 20*a* of the solenoid valve 21*a* is moved to the left in FIG. 13 by switching on the solenoid valve, the plate 100 is elastically deformed in the direction to the valve disc 106 by the pressure piston 98. Accordingly, the hydraulic medium present within the pressure chamber 5*a* is pressurized. As a result of this pressure, the ring 110 is elastically widened so that the hydraulic medium can now flow via the open transverse bores 108 out of the pressure chamber 5*a* and via the transverse bores 109 acting as a work connector of the solenoid valve. As a result of the pressure in the pressure chamber 5*a* the valve disc 106 is pressed tightly into its closed position illustrated in FIG. 13 so that the hydraulic medium cannot reach the bores 105. Accordingly, the camshaft 31 is rotated in the described way into the start position.

When the solenoid valve 21*a* is switched off, the pressure piston 98 and the plunger 20*a* are moved back by means of the plate 100 which is springing back into its initial position. As a result of the vacuum caused in the pressure chamber 5*a*, the valve plate 106 is lifted off the bottom 104 of the bushing 101 so that the hydraulic medium of the intermediate storage 7 (FIG. 1) can flow via the line 6 and these bores 105 into the pressure chamber 5*a*. After switching off the solenoid valve 21, the ring 110 returns into its closed position illustrated in FIG. 13; this return is further assisted by the vacuum within the pressure chamber 5*a*. In this way it is ensured that the hydraulic medium flowing in via the bores 105 remains within the pressure chamber 5*a* and is available for the next switching of the solenoid valve 21*a*.

Figure 14:
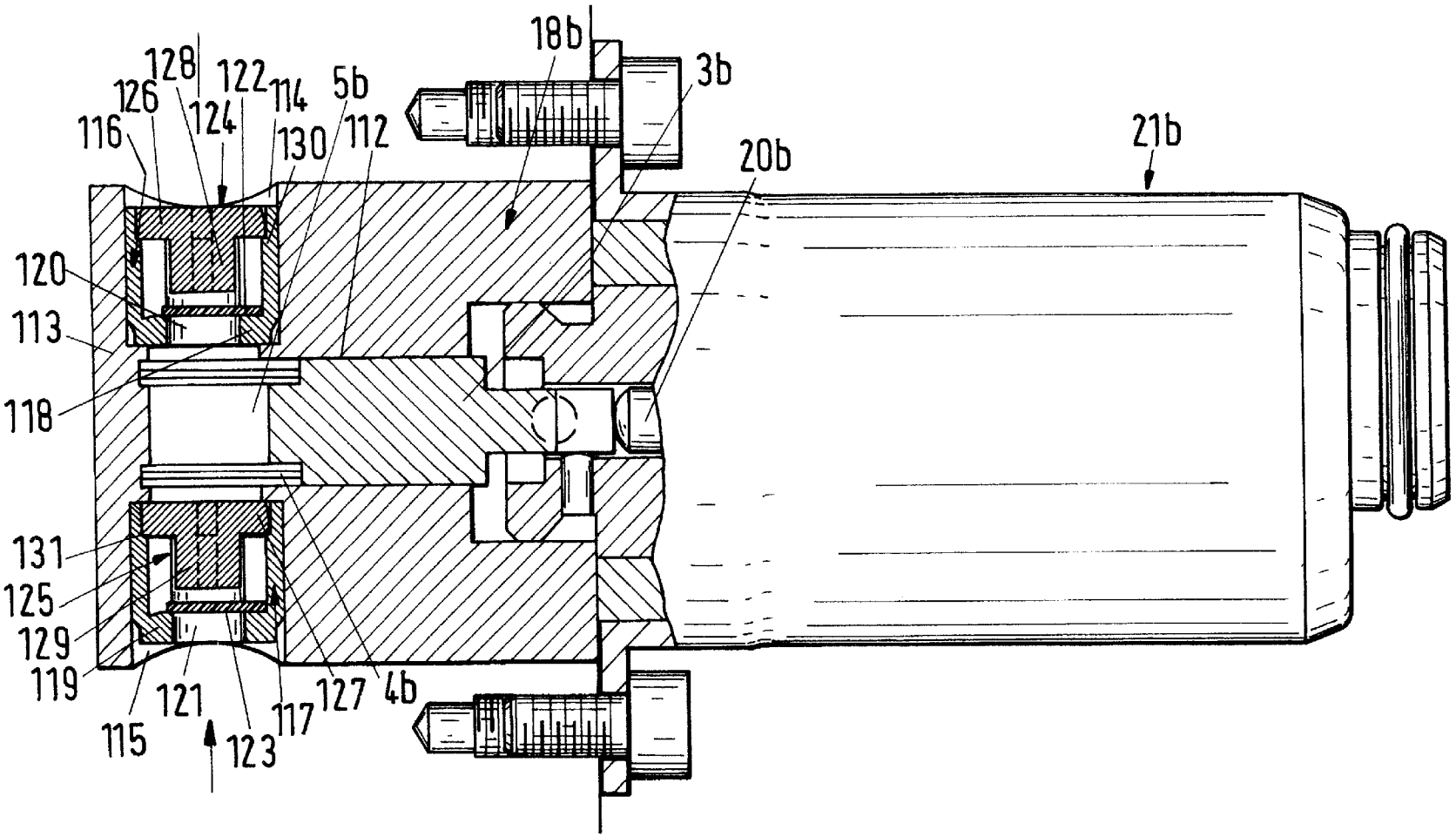
FIG. 14 shows second embodiment of a solenoid valve of the actuating device according to the invention.

In the embodiment according to FIG. 14, the solenoid valve 21*b* comprises the plunger 20*b*, acting on the piston 3*b*. It is guided in an axial bore 112 of the valve housing 18*b*. The pressure chamber 5*b* is axially limited by the piston 3*b* and the bottom 113 of the valve housing 3*b*. At least two transverse bores 114 and 115 open into the pressure chamber 5*b*; these bores 114, 115 are provided in the valve housing 18*b*. The transverse bore 115 is connected to the hydraulic line 6 (FIG. 1) via which the hydraulic medium can be conveyed from the intermediate storage 7 into the pressure chamber 5*b*. The pressure connector P (FIG. 1) is connected to the transverse bore 114.

In the two transverse bores 114, 115 a bushing 116, 117 is positioned, respectively. The bottom 118, 119 of the bushing 116, 117 is provided with a central through bore 120, 121, respectively. The through opening 120 of the bushing 116 faces the pressure chamber 5*b* while the through opening 121 of the bushing 117 faces away from the pressure chamber 5*b*. At the bottom 118, 119 of the bushing 116, 117 a valve element in the form of an elastically deformable valve disc 122, 123 is positioned, respectively, which is connected in a suitable way to the bottom 118, 119 and closes the through openings 120, 121 in the closed position.

A flow distributor 124, 125 is inserted into the two bushings 116, 117, respectively, which has radially outwardly projecting arms 126, 127 arranged in a star shape allowing the hydraulic medium to flow therebetween into the pressure chamber 5*b* or out of the pressure chamber 5*b*. The arms 126, 127 project radially from the upper end of a central base body 128, 129 which is surrounded at a spacing by the bushing 116, 117. The arms 126, 127 of the flow distributor 124, 125 are provided on a radial shoulder surface 130, 131 at the inner side of the bushings 116, 117 and are connected thereto in a suitable way. It is also possible to press the arms 126, 127 into the bushings 116, 117.

The through opening 121 is connected to the hydraulic line 6 (FIG. 1) via which the hydraulic medium can flow in the way described above into the pressure chamber 5*b*. In this connection, the valve disc 123 lifts off the bottom 119 of the bushing 117 so that the hydraulic medium can flow between the arms 127 of the flow distributor 125 into the pressure chamber 5*b*.

When the solenoid valve 21*b* is excited, the plunger 20*b* is moved to the left in FIG. 14 and entrains the piston 3*b*. The hydraulic medium present within the pressure chamber 5*b* is thus pressurized. As a result of this hydraulic pressure, the valve disc 123 is tightly pressed against the rim of the through opening 121 so that the opening 121 acting as a supply opening is reliably closed off. At the same time, the valve disc 122 is elastically bent so that the through opening 120 providing a work connector of the solenoid valve is released. The hydraulic medium can thus flow from the pressure chamber 5*b* between the arms 126 of the flow distributor 125 to the pressure connector P and from there to the respective consumer connectors A or B. The camshaft 31 is then rotated in the described way into the start position. When the solenoid valve 21*b* is switched off, the piston 3*b* is moved back by the pressure spring 4*b* into its initial position so that the plunger 20*b* is moved back into its initial position. Upon return of the piston 3*b*, a vacuum is produced in the pressure chamber 5*b* so that in the described way the hydraulic medium is sucked in from the intermediate storage 7. As a result of the vacuum being present in the pressure chamber 5*b*, the valve disc 122 moves back into the illustrated closed position and closes off the through opening 120.

Figure 15:
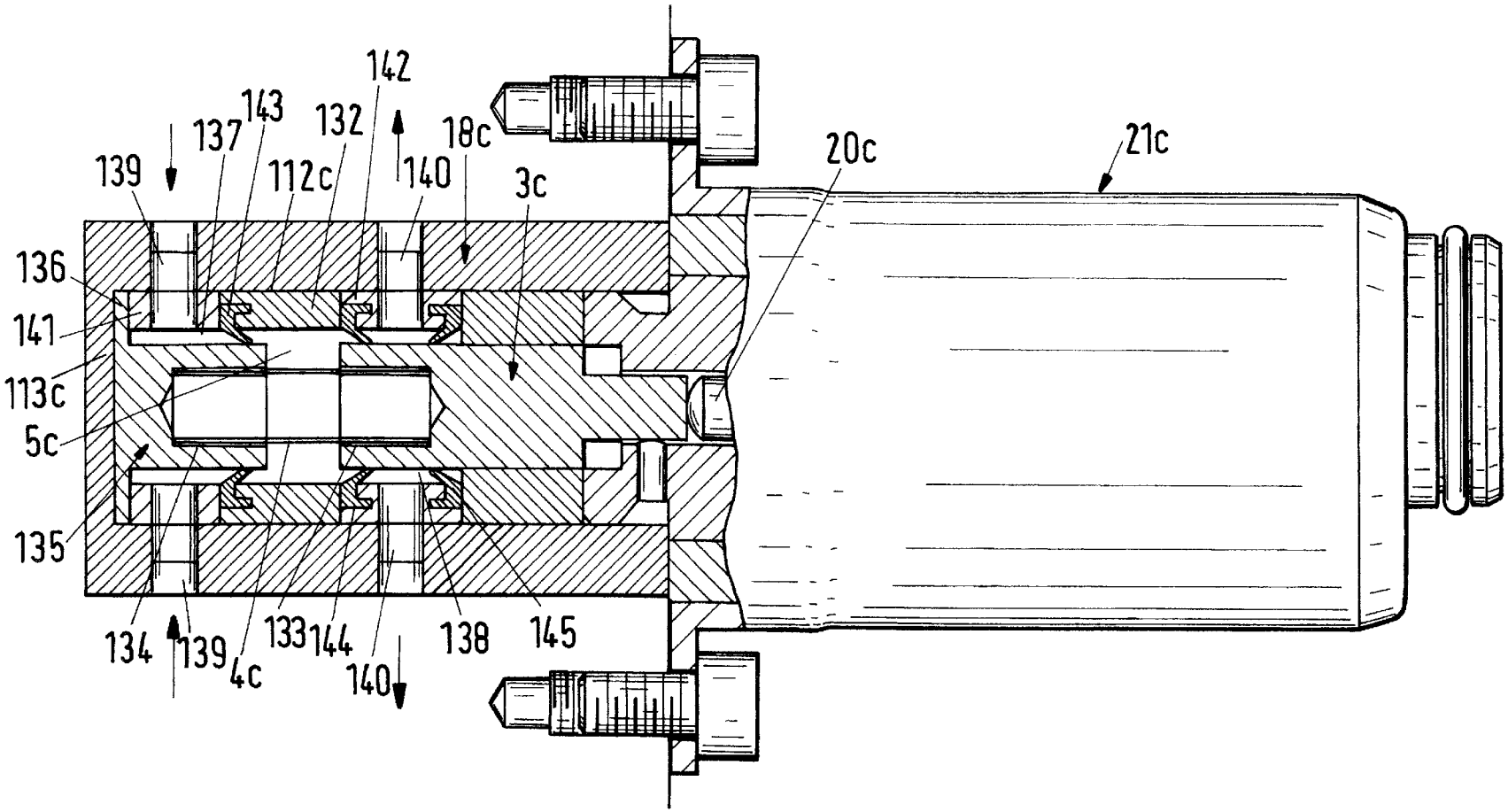
FIG. 15 shows a third embodiment of a solenoid valve of the actuating device according to the invention.

The solenoid valve 21*c* according to FIG. 15 has a plunger 20*c* acting on the piston 3*c*. It is guided over a portion of its length on the inner wall of the bushing 132 which is inserted into the axial bore 112*c* of the valve housing 18*c*. The piston 3*c* is provided at its end face facing away from the plunger 20*c* with a central depression 133 which is engaged by one end of a pressure spring 4*c*. The other end of the spring 4*c* is seated in a central depression 134 of a cup-shaped receptacle 135 which is clamped with an end flange 136 between the bottom 113*c* of the valve housing 18*c* and a ring 141 resting against the bushing 132. The bushing 132 surrounds the receptacle 135 at a spacing so that between the bushing and the receptacle an annular space 137 is provided through which the hydraulic medium can flow into the pressure chamber 5*c* in a way to be described later. A further annular chamber 138 is formed between the bushing 132 and a portion of the length of the piston 3*c*.

Through bores 139 and 140, distributed about the circumference of the valve housing 18*c*, open into the annular chambers 137 and 138 and penetrate the valve housing 18*c* and the bushing 132 radially. Two rings 141, 142 are inserted into the bushing 132 with which seals in the form of sealing rings 143 to 145 are secured which are arranged at the inner wall of the bushing 132 and are fastened thereto. At the level of the through bores 139, 140 the two seals or rings 141, 142 are provided with corresponding bores. The sealing ring 143 is positioned at a spacing from the flange 136 of the receptacle 135 and seals the annular chamber 137 relative to the pressure chamber 5*c*.

The annular chamber 138 is delimited by the sealing rings 144 and 145, which are positioned at an axial spacing to one another, wherein the sealing ring 144 seals the annular chamber 138 relative to the pressure chamber 5*c*. The sealing lips of the sealing rings 144, 145 are oriented slantedly toward one another.

When the solenoid valve 21*c* is supplied with current, the plunger 20*c* is moved to the left of FIG. 15 and entrains the piston 3*c* against the force of the pressure spring 4*c*. The hydraulic medium present within the pressure chamber is thus pressurized. The sealing lip of the sealing ring 144 is elastically deformed by the hydraulic medium pressure such that the hydraulic medium can flow (see flow arrows) across the sealing ring 144 to the through bore 140 acting as a work connector of the solenoid valve. From here, the hydraulic medium flows in the described way to the camshaft adjuster 32 in order to rotate the camshaft 31 quickly into the start position. Since the sealing lip of the sealing ring 143 is oriented at a slant toward the sealing ring 144, the sealing lip is pressed by the pressurized hydraulic medium tightly against the outer wall of the receptacle 135 so that flow of the pressurized hydraulic medium from the pressure chamber 5*c* into the annular chamber 137 is reliably prevented.

When the solenoid valve 21*c* is switched off, the piston 3*c* is returned by the force of the pressure spring 4*c* so that the plunger 20*c* is returned into the initial position. As a result of the return of the piston 3*c* a vacuum is produced in the pressure chamber 5*c* by which the hydraulic medium, via the through bores 139, is sucked in from the intermediate storage via the hydraulic line 6 (see flow arrows). This hydraulic medium flows via the annular chamber 137 and the sealing ring 143 into the pressure chamber 5*c*. As a result of the vacuum within the pressure chamber 5*c* the sealing lip of the sealing ring 144 is tightly pressed against the outer wall of the piston 3*c* so that the annular chamber 138 is reliably sealed against the pressure chamber 5*c*.

Figure 16:
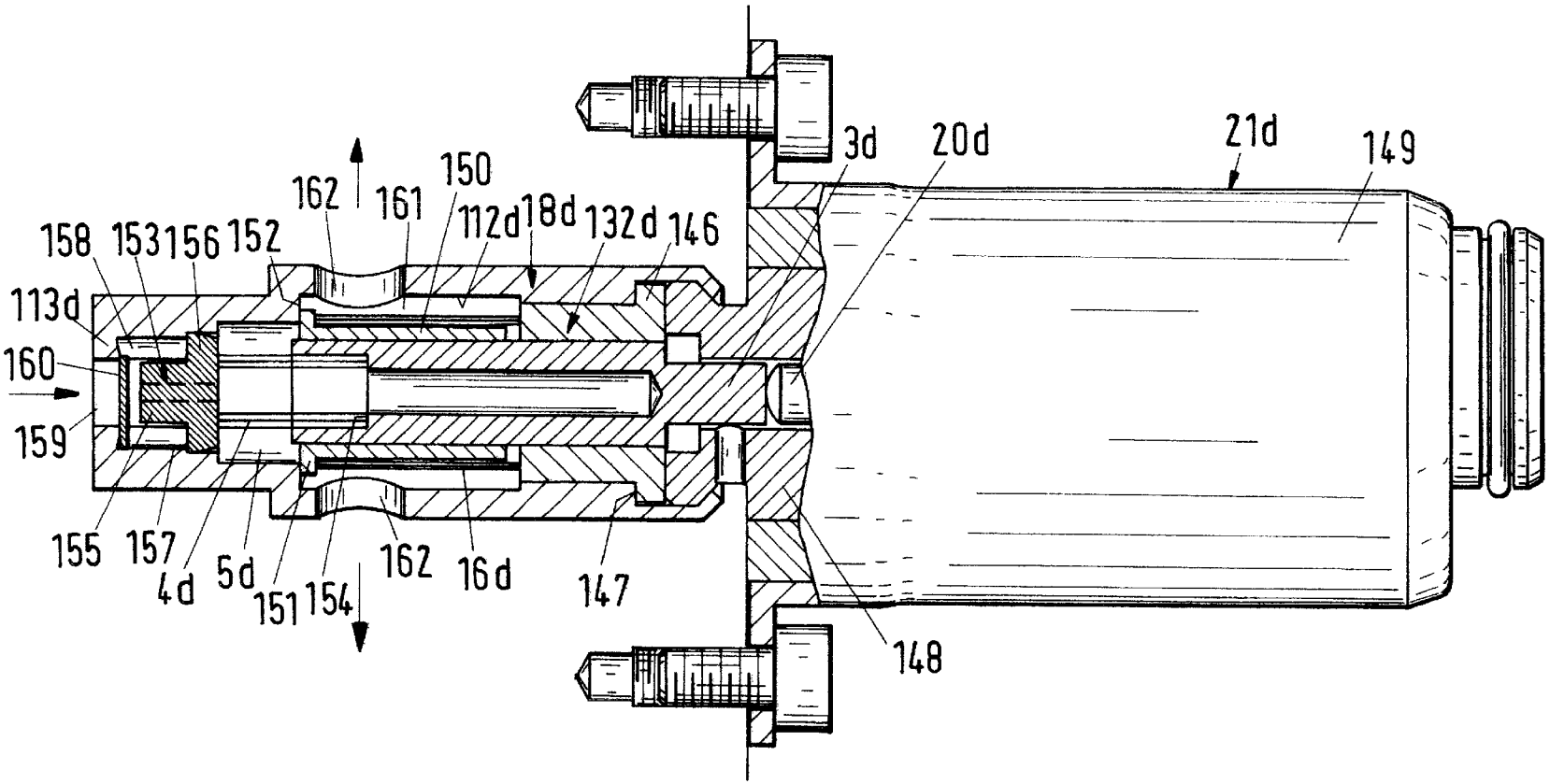
FIG. 16 shows a fourth embodiment of a solenoid valve of the actuating device according to the invention.

FIG. 16 shows a solenoid valve 21*d* whose plunger 20*d* rests against the piston 3*d*. It is axially guided across a portion of its length in the bushing 132*d*. A radially outwardly oriented flange 146 is provided at its end facing the plunger 20*d* and the flange 146 rests with a radial shoulder surface 147 against the inner side of the valve housing 18*d*. The solenoid valve 21*d* has a central base body 148 which, in accordance with the preceding embodiments, projects axially past the housing part 149 of the magnet part of the solenoid valve 21*d*. The projecting end of the base body 148 is mushroom-shaped. The valve housing 18*d* is positive-lockingly placed and secured onto the projecting end by crimping. The flange 146 of the bushing 132*d* is secured by clamping between the shoulder surface 147 and the end face of the projecting end of the base body 148.

An auxiliary piston 150 is seated on the piston 3*d* and has at the end facing away from the bushing 146 a radially outwardly oriented flange 151. When the solenoid valve 21*d* is not supplied with current, the flange 151 of the auxiliary piston 150 rests under the force of the pressure spring 16*d* against a radially inwardly extending shoulder surface 152, wherein the shoulder surface 152 is provided at the inner wall of the axial bore 112*d* of the valve housing 18*d*. The spring 16*d* is supported with its other end on the end face of the bushing 132*d*.

The piston 3*d* is subjected to the force of the pressure spring 4*d* which is supported with one end on the flow body 153 and with its other end on the inner radial shoulder surface 154 within the piston 3*d*. The flow body 153 is identical to the flow distributor 124, 125 and has arms 156 projecting radially from the end of the base body 155 which are positioned at a spacing to one another and thus form passages for the hydraulic medium. The arms 156 are positioned on a radial shoulder surface 157 at the inner wall of the bore 112*d* of the valve housing 18*d*. The base body 155 is surrounded at a spacing by the inner wall of the valve housing 18*d* so that an annular chamber 158 is formed between the base body 155 and the inner wall of the valve housing 18*d*. A supply opening in the form of a bore 159 opens centrally at the bottom 113*d* of the valve housing 18*d* into the annular chamber 158. The bore 159 is closed by a valve element in the form of a valve disc 160 which is comprised of elastically yielding material and is connected to the bottom 113*d* such that it can be elastically bent away for opening the bore 159.

The auxiliary piston 150 delimits radially inwardly an annular chamber 161 which is delimited radially outwardly by the wall of the valve housing 18*d*. Through bores 162 radially penetrate the wall of the valve housing 18*d* and open into this annular chamber 161.

When the solenoid valve 21*d* is not supplied with current, the auxiliary piston 150 rests seal-tight under the force of the pressure spring 16*d* on the shoulder surface 152. Accordingly, the annular chamber 161 is separated from the pressure chamber 5*d* which is positioned between the piston 3*d* and the flow body 153. The valve disc 160 closes the axial bore 159. When the solenoid valve 21*d* is supplied with current, the plunger 20*d* moves the piston 3*d* against the force of the pressure spring 4*d* so that the hydraulic medium present within the pressure chamber 5*d* is pressurized. This pressure is greater than the counter force exerted by the pressure spring 16*d* onto the auxiliary piston 150 so that the auxiliary piston 150 is returned by the hydraulic medium. Accordingly, the hydraulic medium can flow from the pressure chamber 5*d* through the bores 162, acting as a work connector of the solenoid, to the camshaft adjuster 32 in order to quickly rotate the camshaft 31 into the start position. The pressurized hydraulic medium present within the pressure chamber 5*d* tightly forces the valve disc 160 into its closed position.

As soon as the solenoid valve 21*d* is switched off, the piston 3*d* and thus also the plunger 20*d* are moved back by the pressure spring 4*d* into the initial position according to FIG. 16. Accordingly, in the pressure chamber 5*d* vacuum is generated. The auxiliary piston 150, assisted by the pressure spring 16*d*, is returned on the piston 3*d* into its closed position according to FIG. 16 so that the pressure chamber 5*d* is separated from the through bores 162. As a result of the vacuum, the valve disc 160 is elastically deformed such that hydraulic medium can flow from the intermediate storage 7 via the hydraulic line 6 (FIG. 1) via the bore 159, the annular chamber 158, and the passages between the arms 156 of the flow body 153 into the pressure chamber 5*d*.

The described solenoid valves 21*a* to 21*d* according to FIGS. 13 to 16 can be used in connection with the adjusting devices according to FIGS. 1 through 9. Moreover, the solenoid valves 21*a* to 21*d*, of course, can also be used anywhere where a medium intake is to be performed by vacuum and the medium is to be supplied under pressure to a consumer.

While specific embodiments of the invention have been shown and described in detail to illustrate the inventive principles, it will be understood that the invention may be embodied otherwise without departing from such principles.

What is claimed is:

1. An actuating device for securing a camshaft of an engine of a motor vehicle in a start position and for moving the camshaft out of the start position, the actuating device comprising:

a tank connector;

a pressure connector;

work connectors;

a solenoid valve having a plunger;

a piston rod;

a slide arranged externally on the piston rod and slidable relative to the piston rod;

wherein the plunger acts on the piston rod to move the piston rod against a first counter force out of an initial position;

wherein the piston rod has a stop and the slide is moveable by the stop against a second counter force;

wherein the slide is configured to connect the tank connector or the pressure connector alternatively to the work connectors.

2. The actuating device according to claim 1, wherein the piston rod comprises a piston configured to secure the piston in the initial position.

3. The actuating device according to claim 2, further comprising a pressure spring that provides the first counter force.

4. The actuating device according to claim 2, further comprising a pressure chamber and a pressure line connected to the pressure chamber, wherein the piston is arranged in the pressure chamber and wherein the pressure line is configured to supply a hydraulic medium from a tank to the pressure chamber.

5. The actuating device according to claim 4, wherein the pressure chamber is connected to an intermediate storage.

6. The actuating device according to claim 5, wherein the intermediate storage and the tank are connected to one another.

7. The actuating device according to claim 4, wherein the intermediate storage is open to an ambient atmosphere.

8. The actuating device according to claim 4, wherein the intermediate storage is a pressure storage.

9. The actuating device according to claim 1, wherein the slide and the piston are parts of the solenoid valve.

10. The actuating device according to claim 1, further comprising a pressure spring that provides the second counter force.

11. The actuating device according to claim 1, wherein the solenoid valve has a valve part embodied as a pump.

* * * * *